United States Patent [19]

Pringle

[11] Patent Number: 4,854,387

[45] Date of Patent: Aug. 8, 1989

[54] LARGE BORE RETRIEVABLE WELL SAFETY VALVE

[75] Inventor: Ronald E. Pringle, Houston, Tex.

[73] Assignee: Camco, Incorporated, Houston, Tex.

[21] Appl. No.: 255,818

[22] Filed: Oct. 11, 1988

[51] Int. Cl.[4] ..... E21B 34/10

[52] U.S. Cl. ..... 166/321; 166/166; 166/332; 251/62

[58] Field of Search ..... 166/319, 321, 322, 332, 166/334, 117, 166, 169, 208, 237; 137/527.6; 251/62

[56] References Cited

U.S. PATENT DOCUMENTS

| | | | |
|---|---|---|---|
| 4,161,219 | 7/1979 | Pringle | 166/324 |
| 4,252,197 | 2/1981 | Pringle | 251/62 |
| 4,437,522 | 3/1984 | Krause, Jr. et al. | 166/237 |
| 4,531,587 | 7/1985 | Fineberg | 166/332 |
| 4,585,067 | 4/1986 | Blizzard et al. | 166/319 |
| 4,597,445 | 7/1986 | Knox | 166/319 |
| 4,660,646 | 4/1987 | Blizzard | 166/321 |
| 4,691,776 | 9/1987 | Pringle | 166/319 |

*Primary Examiner*—Jerome W. Massie, IV
*Assistant Examiner*—Terry Lee Melius
*Attorney, Agent, or Firm*—Fulbright & Jaworski

[57] ABSTRACT

A retrievable well subsurface safety valve having a valve seat and an arculate valve closure member on the bottom of the housing for increasing fluid flow through the bore of the housing. A nose, separate from the housing, is adapted to be connected in the well conduit below the bottom of the housing for protecting the valve closure member. The subsurface safety valve may be rotationally oriented to connect a flow control passageway to a port in the well conduit. A landing nipple includes a port for receiving hydraulic control fluid, a latching recess for latching the valve housing, and a latching recess for latching the nose, and orientation mechanism for rotating the safety valve relative to the port.

11 Claims, 3 Drawing Sheets

LARGE BORE RETRIEVABLE WELL SAFETY VALVE

BACKGROUND OF THE INVENTION

Retrievable subsurface well safety valves are utilized in oil and/or gas wells for installation in the well production conduits for protecting the well. Such valves are installed and retrieved by various methods such as wireline operations or pumpdown operations. However, retrievable safety valves which are inserted into the well conduit restrict the well bore and thereby restrict and reduce the amount of well production that can be obtained through the well conduit. One common type of safety valve is the flapper type valve shown in U.S. Pat. No. 4,161,219. The flapper valve is positioned in a valve housing and a flow tube or tubular member telescopically moves through the housing for controlling the movement of the flapper in response to a hydraulic piston and cylinder assembly.

However, flapper valves restrict and limit the size of the bore through the valve. As disclosed in U.S. Pat. No. 4,531,587, a curved or arcuate flapper valve has been used so that in the open position a larger bore may be provided in the valve thus enlarging the valve flow area.

Also, retrievable safety valves require an annular hydraulic chamber for mating with a hydraulic fluid control port in the well conduit for actuating the valve piston and cylinder assembly. This hydraulic chamber again takes up space and reduces the area of the bore through the valve.

One feature of the present invention is the provision of a curved or arcuate flapper type retrievable safety valve in which the valve seat and arcuate flapper are connected to the bottom of the valve housing thereby further increasing the available space for enlarging the bore through the valve housing. In this case, the well conduit acts as a protective housing. A nose separate from the valve housing is provided to coact with the flow tube or tubular member to protect the valve seat and the valve closure member when the valve is in the open position.

Another feature of the present invention is the provision of a retrievable safety valve having a control fluid passageway which extends from the piston and cylinder assembly to a single circumferential position on the exterior of the housing and in which the housing may be oriented to bring the fluid passageway into alignment with a hydraulic control port in the well conduit. This feature again allows an increase in the cross-sectional area of the bore through the housing.

As an example, a 4½" retrievable well safety valve constructed in accordance with U.S. Pat. No. 4,161,219 has an internal diameter of 2.125 inches which provides a cross-sectional area of 3.5 square inches. By utilizing the structure of the present invention, a 4½" retrievable safety valve may be provided having an internal diameter of 2.765 inches which provides a cross-sectional area of 6.0 square inches thereby increasing the well production through the valve.

SUMMARY

One feature of the present invention is the provision of a retrievable well subsurface safety valve for controlling the fluid flow through a well conduit. The valve includes a tubular housing having an axial bore therethrough and the housing includes means for connection to the inside of the well conduit. A valve seat is positioned on the bottom of the housing and an arcuate well valve closure member is provided for moving between open and closed positions relative to the valve seat for controlling the fluid flow through the bore. The valve closure member is pivotally connected to the bottom of the housing. A longitudinal tubular member is telescopically movable in and through the bottom of the housing for controlling the movement of the valve closure member and hydraulic piston and cylinder means are provided in the housing connected to and actuating the tubular member. A nose is provided separate from the housing, and the nose includes means for connection to the inside of the well conduit for setting the nose in the conduit below the bottom of the housing. Thus, the valve closure member allows a larger bore in the housing but is protected by the well conduit and the separate nose. Preferably the nose includes seal means for coacting with the tubular member when the valve is in the open position.

Still a further object of the present invention is the provision of a landing nipple for use in the well conduit which includes a body having port means for receiving hydraulic control fluid for actuating the hydraulic piston and cylinder assembly. A housing latching recess is provided in the body for coacting with the housing connection means for latching the housing into the nipple. A nose latching recess is provided in the body for coacting with the nose connection means for latching the nose in the nipple below the housing.

Another feature of the present invention is wherein the housing of the valve includes means defining a fluid passageway extending from the piston and cylinder means to a single circumferential position on the exterior of the housing and coacting orientation means are provided on the housing or the landing nipple for rotationally aligning the fluid passageway single circumferential position with the port means. This structure avoids the use of a circumferential annular hydraulic chamber in the housing thereby allowing the bore of the housing to be increased in area.

Still a further object of the present invention is wherein the means defining a fluid passageway includes a piston movable radially. Preferably means are provided for releasably holding the piston radially inwardly while running the safety valve. Preferably the piston includes a first piston ring sealing against the housing and second and third piston rings positioned for sealing against the landing nipple about the port means. The second piston ring has a smaller circumference than the first piston ring and the third piston ring has a larger circumference than the first piston ring for insuring that the piston will be actuated and sealed against the nipple regardless of whether the hydraulic or the well pressure is greater.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
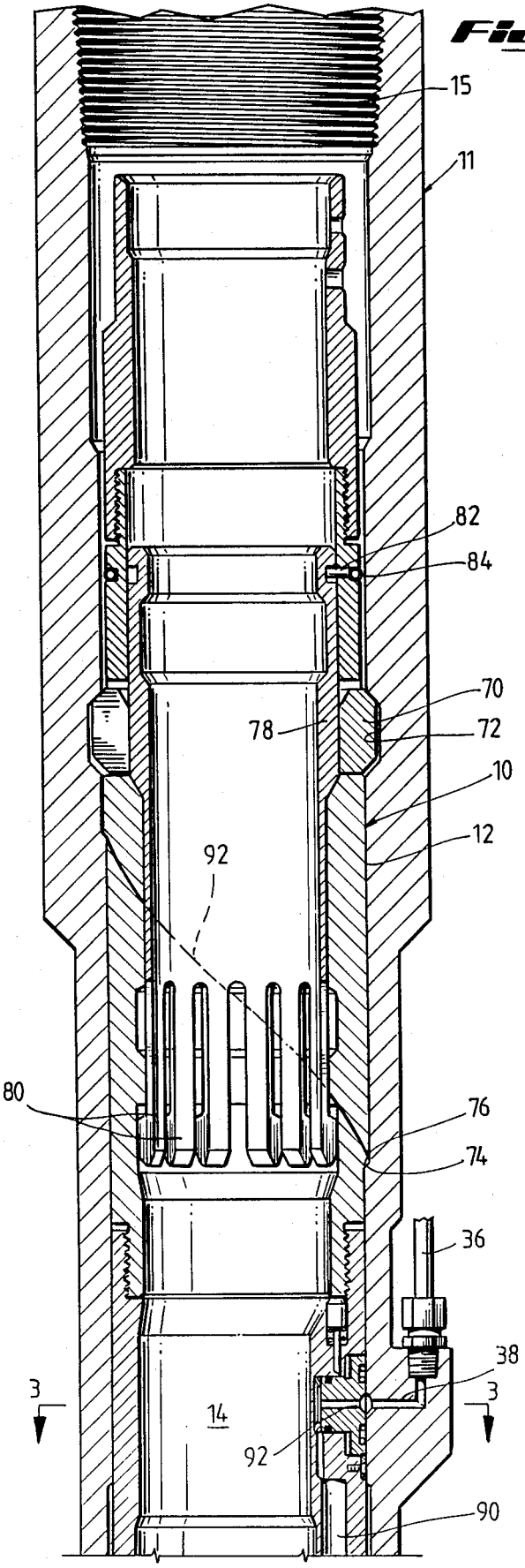
FIGS. 1A, 1B and 1C are continuations of each other and are an elevational view, in cross section, illustrating one embodiment of the present invention.
Figure 1B:
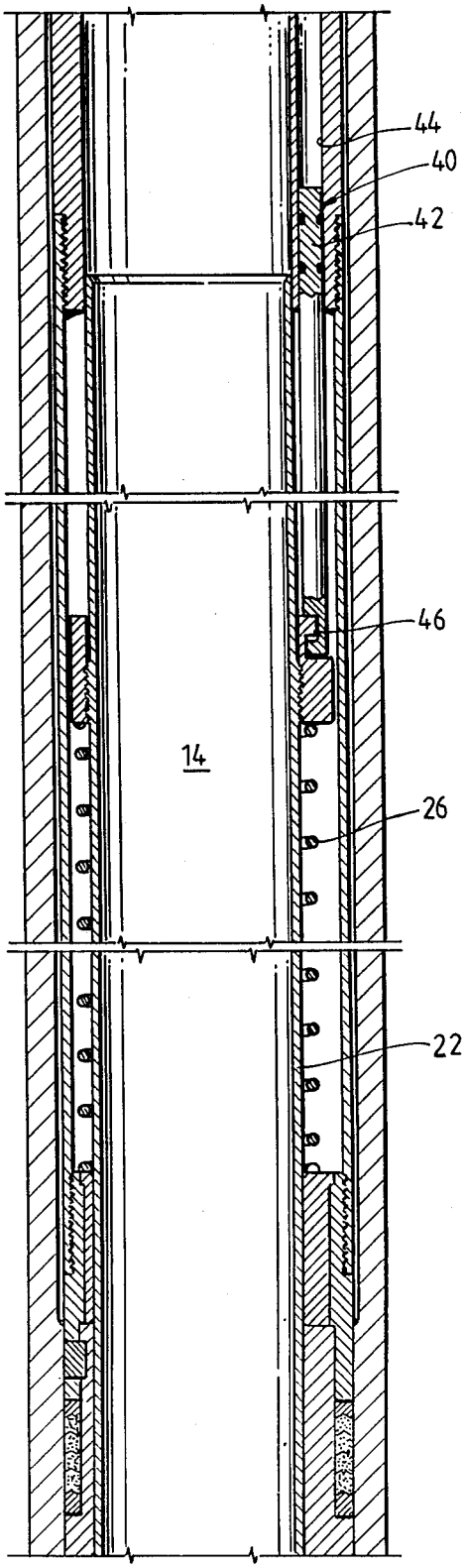
Figure 1C:
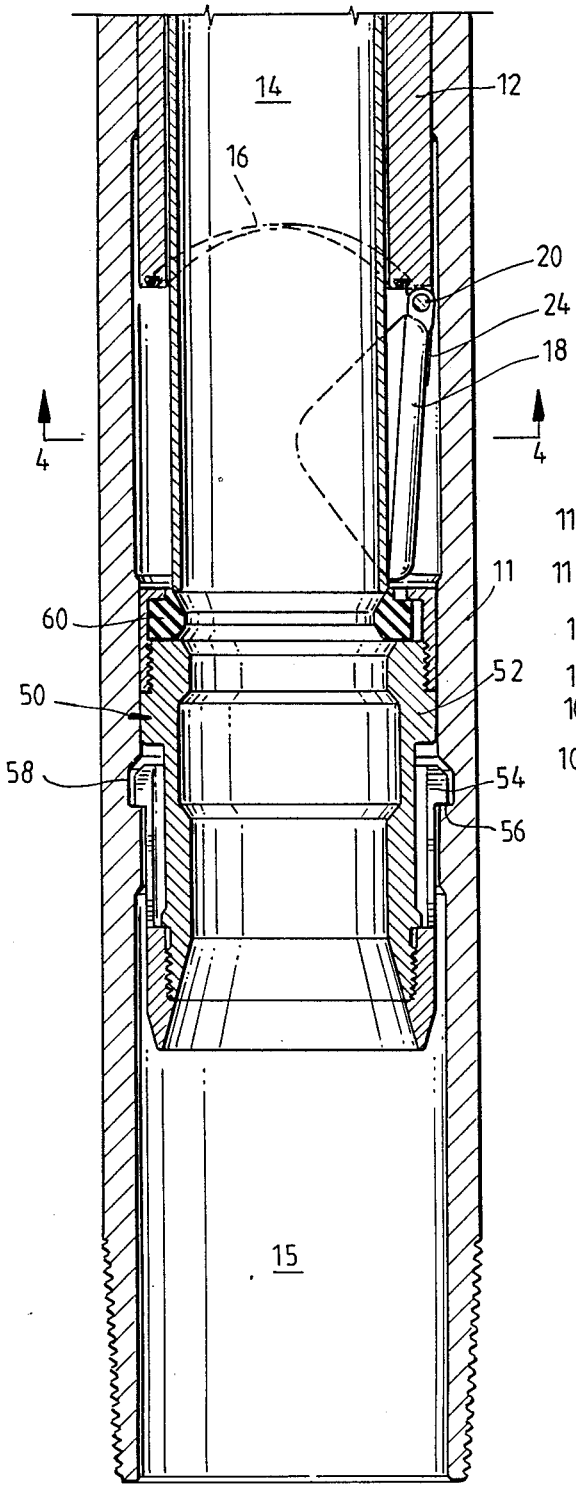

Referring now to the drawings, particularly to FIGS. 1A, 1B and 1C, the reference numeral 10 generally indicates a retrievable subsurface tubing safety valve of the present invention which includes a housing 12 and is adapted to be set in and retrieved from a well tubing which includes a landing nipple generally indicated by the reference numeral 11 to permit well production therethrough under normal operating conditions, but in which the safety valve 10 may be closed in response to abnormal conditions.

The valve 10 includes an axial bore 14, an annular and curved valve seat 16 positioned about the bore 14 and on the bottom of the housing 12. A valve closure element such as flapper valve 18 which is in the form of a curved or arcuate cross-sectional shape is connected to the bottom of the body 12 by a pivot pin 20. Thus, when the flapper valve 18 is in the upper position and seated on the valve seat 16, the safety valve 10 is closed blocking flow upwardly through the bore 14 and well tubing.

A flow tube or longitudinal tubular member 22 is telescopically movable in the body 12 and through the valve seat 16 in the bottom of the housing 12. As best seen in FIG. 1C, when the tubular member 22 is moved to a downward position, the tube 22 pushes the flapper 18 away from the valve seat 16. Thus, the valve 10 is held in the open position so long as the tube 22 is in the downward position. When the tube is moved upwardly, the flapper 18 is allowed to move upwardly onto the seat 16 by the action of a spring 24 and also by the action of fluid flow moving upwardly through the bore 14 and behind the flapper 18.

The tubular member 22 is biased in an upward direction by suitable means which may include a spring 26 (FIG. 1B) for yieldably urging the member 22 in an upward direction to release the flapper 18 for closing the valve 10. The safety valve 10 is closed by the application or removal of a pressurized fluid, such as hydraulic fluid, through a control path or line such as control line 36 extending to the well surface from a port 38 in the nipple 11 for supplying pressurized fluids to the top of a piston and cylinder means or assembly generally indicated by the reference numeral 40. The assembly 40 includes a piston 42 movable in a cylinder 44, one of which, here shown as the piston 42, is connected to the flow tube 22 by a tongue and groove connection 46.

However, a retrievable safety valve, such as 10, by being positioned in the inside of the well tubing including the landing nipple 11 has a longitudinal bore 14 which is less than the bore 15 of the well tubing. It is therefore important to make the cross-sectional area of the bore 14 as large as possible in order to maximize the well production therethrough. Flapper valves normally are disposed in a recess in the side wall of the housing when in the open position thereby restricting the size of the bore. As has been indicated, in order to reduce the obstruction of the flapper valve, valves in the configuration of a cylindrical segment have been used. These so-called curved or arcuate cross-sectional flapper valves have been provided so that in their open position they will allow enlargement of the bore or flow area. As best seen in FIG. 1C, one of the features of the present invention is the provision of a curved or arcuate flapper 18 which is not positioned inside of the housing 12 but which is provided with a valve seat 16 and a connection at the bottom of the housing 12. By positioning the flapper 18 out of the housing 12, the cross-sectional area of the bore 14 of the valve 10 can be maximized.

However, the valve seat 16 and the flapper 18 must be protected from erosion by the well fluids flowing upwardly through the bore 14 when the flapper 18 is in the open position. It is noted from FIG. 1C that the landing nipple 11 acts as one protective wall for the flapper 18. In addition, a nose generally indicated by the reference numeral 50 is provided which is separate from the valve housing 12 and positioned in the landing nipple 11 below the bottom of the housing 12. The nose 50 includes a body 52 and means for connection to the inside of the nipple 11 such as collet fingers 54 which have a downwardly directed shoulder 56 which engage and latch into a nose latching recess 58 in the landing nipple 11. Preferably the body 52 carries a seal 60 for engagement by the tubular member 22 when it is in the downward position. Preferably the seal 60 floats in the body 52 as the bore 14 in the valve housing 12 may be slightly eccentric to the bore 15 in the landing nipple 11. In any event, when the valve is in the open position and the tubular member 22 seats against the seal 60, the flapper 18 and valve seat 16 are protected against erosion by production fluid.

The nose 50 is installed into the landing nipple 12 by a suitable well prong which lowers the nose 50 into the nipple 12 until the shoulders 56 engage the recess 58 at which time the prong may be released from the nose 50 and retrieved. Thereafter, the housing 12 of the safety valve 10 is installed in the landing nipple 11.

Referring now to FIG. 1A, the valve 10 is generally run into the well conduit and landing nipple 11 on a wireline or pumpdown, for example, a Camco wireline B-6 running tool. The housing 10 includes suitable means for connection to the inside of the landing nipple 11 such as locking dogs 70 which are in the retracted position while being run in but are here shown as set in a housing latching recess 72 in the landing nipple 11. The housing 12 is normally run into the nipple 11 until a no go shoulder 74 on the housing 12 engages a stop shoulder 76 in the landing nipple 11. Thereafter, a sleeve 78 is moved downwardly to latch the dogs 70 outwardly into the recess 72. The sleeve 78 is held in a releasably latch position by collet fingers 80 and pins 82 biased inwardly by a garter spring 84.

Generally, retrievable subsurface safety valves include an annular hydraulic chamber in the housing for receiving hydraulic control fluid from a port 38 in a landing nipple 11. However, such a structure increases the required thickness of the housing and thus limits the cross-sectional area of the axial bore.

The present invention avoids the use of a circular hydraulic chamber in the safety valve 10 and instead, as best seen in FIGS. 1A, 1B, 2 and 3, provides a hydraulic fluid passageway 90 extending from the hydraulic piston and cylinder assembly 40 to a single circumferential end position 92 on the outer circumference of the housing 12. Since the hydraulic passageway 90 is positioned only on one side in the housing 12, this allows the bore 14 to be increased in cross-sectional area. However, with only a single circumferential endposition 92 of the fluid passageway extending from the housing 12, the housing 12 must be oriented in a rotational direction relative to the landing nipple 11 for fully communicating the end position 92 of the fluid passageway with the port 38 in the landing nipple 11. Therefore, as best see in FIG. 1A, coacting orientation means are provided in the landing nipple 11 and on the housing 12 such as a conventional muleshoe guide surface 92 positioned on the inside of the landing nipple 11 for coacting with a key on the housing 12 such as the no go shoulder 74. That is, as the valve 10 is installed in the landing nipple, the no go shoulder 74 will engage the muleshoe orientation guide 92 in the landing nipple and rotate the housing 12 to bring the end 92 of the fluid passageway into rotational alignment with the port 38 in the landing nipple 11.

Figure 2:
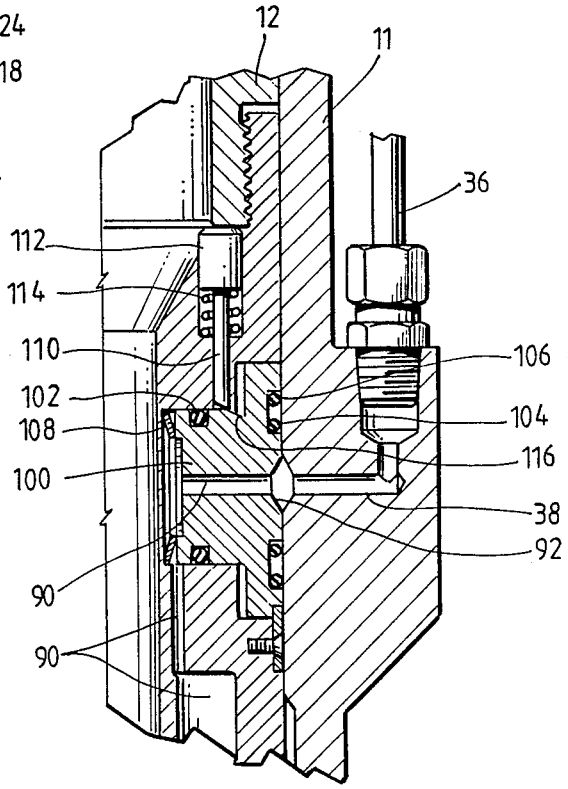
FIG. 2 is an enlarged cross-sectional view taken along the line 2—2 of FIG. 3.
Figure 3:
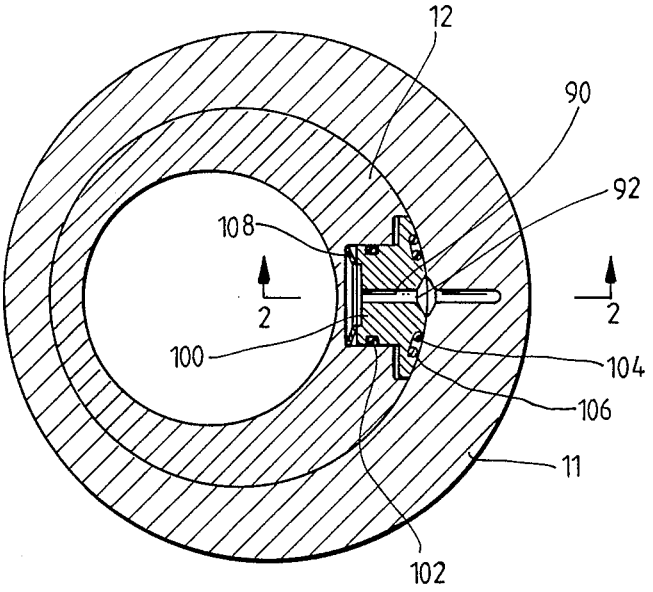
FIG. 3 is a cross-sectional view taken along the line 3—3 of FIG. 1A.
Figure 4:
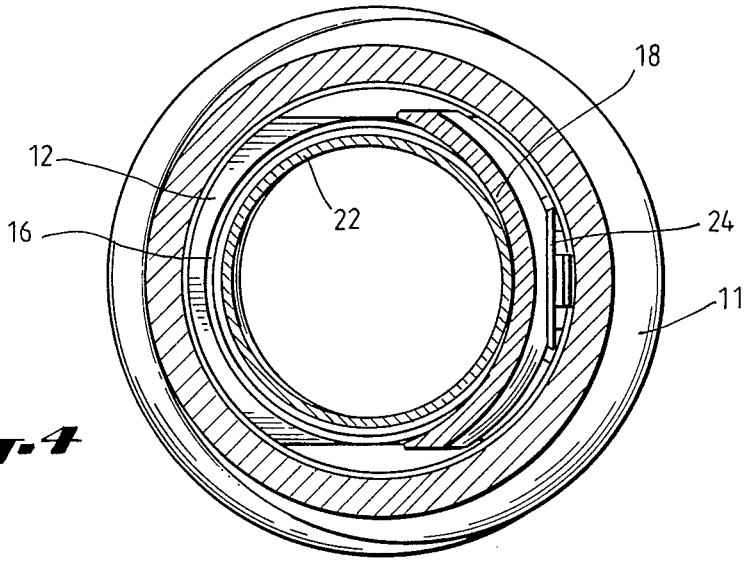
FIG. 4 is a cross-sectional view taken along the line 4—4 of FIG. 1C.

Referring now to FIGS. 1A, 2 and 3, the hydraulic fluid passageway 90 includes a piston 100 through which the passageway extends. The piston 100 is movably carried by the housing 12 for radial movement outwardly from the axis of the housing 12 for seating against the landing nipple 11 and sealingly connecting the fluid passageway 90 with the port 38. The piston 100 includes a first seal means 102 such an O-ring seal for sealing between the piston 100 and the housing 12. The piston also includes second and third O-ring seals 104 and 106, one of which such as seal 104 has a circumference smaller than the circumference of the first seal 102 and the second of which, seal 106, has a circumference greater than the circumference of the first seal 102. By the sizing of the circumferences of the first seal 102, second seal 104, and third seal 106, as described, the piston 100 will be moved radially outward for sealingly engaging the interior of the landing sub 11 irrespective of whether the hydraulic fluid pressure being supplied from the line 36 or the pressure in the bore 14 of the safety valve 10 which is supplied to the bottom of the piston and cylinder assembly 40 and thus to the inside of the piston 100, is greater. In addition, resilient means such as a Bellville spring 108 is provided between the piston 100 and the housing 12 for urging the piston 100 outwardly against the landing sub 11.

Preferably, releasable latch means are provided for initially holding the piston 100 in a retracted position in order to protect the seals 104 and 106 as the safety valve 10 is being installed into the well conduit and nipple 11. The latch means may include a pin 110 having a head 112 and a spring 114 for biasing the pin 110 away from the piston 100. Initially, prior to running the valve 10, a conventional setting tool such as Camco B-6 setting tool is connected to the housing 12 and engages the head 14 to push the pin 110 downwardly into a notch 116 in the piston 100. This holds the piston 100 in the retracted position. After the valve 10 is set in the landing nipple 12 and the setting tool removed, the spring 114 retracts the pin 110 from the notch 116 and allows the piston 100 to move radially outward into a sealing relationship with the landing nipple 11.

In operation, the landing nipple 11 is connected in and forms a part of the well production conduit. The nose 50 is first set in place by being inserted into the bore 15 of the nipple by a prong (not shown) until the collet 54 engage the recess 58 in the landing nipple thereby setting the nose 50 in the nipple 12 and releasing the prong from the nose. Thereafter, the housing 12 is set into the landing nipple 11 and as the key or no go shoulder 74 on the housing 12 engages the muleshoe orientation guide 92, the housing 12 is rotated to bring the fluid passageway end 92 into rotational alignment with the hydraulic fluid control port 38 in the landing nipple 11. Thereafter, the sleeve 78 is actuated to lock the dogs 70 in the locking notch 72 and the landing nipple. Thereafter, the safety valve 10 is controlled by the application and removal of hydraulic pressure in the line 36. When the valve 10 is moved to the open position, as best seen in FIG. 1C, the valve seat 16 and arcuate flapper 18 is protected between the extension of the tubular member 22, the wall of the landing nipple 11, and the nose 40. However, the valve seat 16 and arcuate flapper 18, by being positioned on the bottom of the housing 12, allows the bore 14 of the valve 10 to be maximized.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A retrievable well subsurface safety valve for controlling the fluid flow through a well conduit comprising, a tubular housing having an axial bore therethrough, said housing including a first means for connecting to the inside of the well conduit, a valve seat positioned on the bottom of the housing, an arcuate valve closure member moving between open and closed positions relative to the valve seat for controlling the fluid flow through the bore, said valve closure member pivotally connected to the bottom of the housing, a longitudinal tubular member telescopically movable in an through the bottom of the housing for controlling the movement of the valve closure member, hydraulic piston and cylinder means in the housing connected to and actuating the tubular member, a nose separate from the housing, said nose including a second means for connecting to the inside of the well conduit for setting the nose in the conduit below the bottom of the housing.

2. The apparatus of claim 1 wherein the nose includes seal means for coacting with the tubular member when the valve is in the open position.

3. The apparatus of claim 1 including a landing nipple for use in the well conduit comprising, a body having port means for receiving hydraulic control fluid for actuating the hydraulic piston and cylinder means, a housing latching recess in the body for coacting with the housing first connecting means for latching the housing into the nipple, a nose latching recess in the body for coacting with the nose first connecting means for latching the nose in the nipple below the housing.

4. The apparatus of claim 3 including, said housing including means defining a fluid passageway extending from the piston and cylinder means to a single circumferential position on the exterior of the housing, and coacting orientation means on the housing and the landing nipple for rotational aligning the fluid passageway single circumferential position with the port means.

5. The apparatus of claim 4 wherein the means defining a fluid passageway includes a piston movable radially.

6. The apparatus of claim 5 wherein said piston includes a first piston ring sealing against the housing and second and third piston rings sealing against the nipple about the port means, said second piston ring having a smaller circumference than the first piston ring and the third piston ring having a larger circumference than the first piston ring.

7. The apparatus of claim 5 including, means releasably holding the piston radially inwardly.

8. The apparatus of claim 1 including, a landing nipple for use in the well conduit for receiving the hydraulically actuated well subsurface safety valve and nose comprising, a tubular body having a port for receiving a hydraulic control fluid for actuating the safety valve, orientation means in the body for rotational orientating the safety valve relative to the port, a valve latching recess in the body for latching the safety valve into the body, and a nose latching recess in the body for latching the well safety valve nose in the body below the safety valve.

9. A retrievable well subsurface safety valve for inserting in and for controlling the fluid flow through a well conduit in which said conduit includes a control port comprising, a tubular housing having an axial bore therethrough, said housing including means for connection to the inside of the well conduit, a valve closure member moving between open and closed positions for controlling the fluid flow through the bore, a longitudinal tubular member telescopically moving in the housing for controlling the movement of the valve closure member, hydraulic piston and cylinder means in the housing connected to and actuating the tubular member, said housing including means defining a fluid passageway extending from the piston and cylinder means to a single circumferential position on the exterior of the housing for mating with said control in the well conduit, and orientation means on the housing for coacting with the well conduit for rotational aligning the fluid passageway single circumferential position with the control port.

10. The apparatus of claim 9 wherein the means defining a fluid passageway includes a piston movable radially.

11. The apparatus of claim 10 wherein said piston includes a first piston ring sealing against the housing and second and third piston rings sealing against the nipple about the port means, said second piston ring having a smaller circumference than the first piston ring and the third piston ring having a larger circumference than the first piston ring.

* * * * *

UNITED STATES PATENT OFFICE

CERTIFICATE OF CORRECTION

Patent No. 4,854,387 Dated August 8, 1989

Inventor(s) Ronald E. Pringle

It is certified that error appears in the above-identified patent and that said Letters Patent is hereby corrected as shown below:

Column 6, line 35, delete "an" and insert -- and --

Column 6, line 56, delete "first" and insert -- second --

Column 8, line 15, after "control" insert -- port --

Signed and Sealed this

Eleventh Day of September, 1990

*Attest:*

HARRY F. MANBECK, JR.

*Attesting Officer*

*Commissioner of Patents and Trademarks*